US008595961B2

(12) United States Patent
Mayer et al.

(10) Patent No.: US 8,595,961 B2
(45) Date of Patent: Dec. 3, 2013

(54) THREE DIMENSIONAL FOAM GREETING CARDS

(75) Inventors: David Mayer, Bay Village, OH (US); Terry Hughes, Avon, OH (US); Jerry Guo, Shanghai (CN); John Talbot, Bay Village, OH (US); Sharon Bogdanski, Westlake, OH (US)

(73) Assignee: American Greetings, Cleveland, OH (US)

( * ) Notice: Subject to any disclaimer, the term of this patent is extended or adjusted under 35 U.S.C. 154(b) by 10 days.

(21) Appl. No.: 13/476,326

(22) Filed: May 21, 2012

(65) Prior Publication Data

US 2013/0139417 A1 Jun. 6, 2013

Related U.S. Application Data

(63) Continuation-in-part of application No. 13/004,544, filed on Jan. 11, 2011, now Pat. No. 8,205,365.

(60) Provisional application No. 61/293,852, filed on Jan. 11, 2010.

(51) Int. Cl.
*G09F 1/00* (2006.01)

(52) U.S. Cl.
USPC ..... 40/124.03; 40/124.08; 40/538; 40/455

(58) Field of Classification Search
USPC ..... 40/124.03, 124.08, 455–457, 538
See application file for complete search history.

(56) References Cited

U.S. PATENT DOCUMENTS 4,055,014 A 10/1977 Schmidt et al.
4,299,041 A 11/1981 Wilson
4,670,820 A * 6/1987 Eddins et al. ..... 362/86
5,139,454 A 8/1992 Earnest
5,543,678 A 8/1996 Hoiberg
5,641,164 A 6/1997 Doederlein et al.
5,748,082 A 5/1998 Payne
5,988,684 A 11/1999 Blaustein et al.
6,282,819 B1 9/2001 Gu
6,523,285 B1 2/2003 Gilson et al.
7,508,393 B2 3/2009 Gordon et al.
7,806,745 B2 10/2010 Hohl
D643,061 S * 8/2011 McClain et al. ..... D19/7
8,176,663 B2 * 5/2012 Sapp et al. ..... 40/124.03
8,322,058 B2 * 12/2012 Mayer et al. ..... 40/491
2007/0209243 A1 9/2007 Toulotte
2008/0032587 A1 2/2008 Krivanek et al.

(Continued)

FOREIGN PATENT DOCUMENTS

GB 2393935 4/2004

*Primary Examiner* — Casandra Davis
(74) *Attorney, Agent, or Firm* — Christine Flanagan

(57) ABSTRACT

Three-dimensional lightweight foam greeting cards are described herein having a foam body with a perimeter wall that extends between two spaced apart parallel pieces of planar sheet material such as heavy gauge paper, cardboard, or other such material. The greeting cards have a partially hollowed foam body or one or more cavities in the foam body concealed in the front and back by the planar sheet material which may be pre-cut in the shape of the foam body are decorated consistent with the design of the foam body. The cavities in the foam body may contain various electronic components that enable the greeting card to produce sound, record and playback a personalized message, trigger light activation, trigger the movement of moveable parts, display digital video, photographs or slideshows, or a combination thereof.

20 Claims, 10 Drawing Sheets

(56) References Cited

U.S. PATENT DOCUMENTS

| | | | | |
|---|---|---|---|---|
| 2009/0126239 | A1 | 5/2009 | Clegg | |
| 2009/0217559 | A1* | 9/2009 | Sayre | 40/124.06 |
| 2009/0241387 | A1 | 10/2009 | Wong | |
| 2010/0056021 | A1 | 3/2010 | Carlson et al. | |
| 2012/0000100 | A1* | 1/2012 | Jin et al. | 40/124.02 |
| 2012/0000101 | A1* | 1/2012 | Jin et al. | 40/124.03 |
| 2012/0317850 | A1* | 12/2012 | Guo et al. | 40/124.03 |

* cited by examiner

THREE DIMENSIONAL FOAM GREETING CARDS

RELATED APPLICATIONS

This application is a continuation-in-part of and claims priority to U.S. patent application Ser. No. 13/004,544, filed on Jan. 11, 2011, which is incorporated herein by reference in its entirety.

FIELD OF THE INVENTION

The present invention relates to greeting cards, and more specifically to three-dimensional foam greeting cards and decorative greeting card accessories.

BACKGROUND OF THE INVENTION

For many years paper greeting cards have been widely used for celebratory occasions such as birthdays, graduations, weddings and other commercial purposes. Traditional text information is generally found on paper greeting cards. More recently, sound has been added to traditional paper greeting cards to increase the personalization of the cards by delivering an audio message that is electronically embodied in circuitry that is carried within the greeting card. The ability to use sound in combination with printed matter such as with conventional printed greeting cards significantly enhances the communicative value of social and relational greetings. The availability of small voice recording sound modules has made sound-generating greeting cards increasingly popular. Small lighting systems have also been incorporated into social greeting products and novelties, and combined in circuits with sound and other features.

SUMMARY OF THE INVENTION

A three-dimensional foam greeting card is described herein, in one embodiment, having a three-dimensional foam body, a first planar surface material attached to a front surface of the three-dimensional foam body, a second planar surface material attached to a back surface of the three-dimensional foam body and a sound module located in a recess in the three-dimensional foam body and concealed by the first and second planar surface material. The sound module may include a speaker, circuit board, integrated circuit, microprocessor, memory device, power source, at least one switch mechanism and at least one pre-loaded digital audio file. The at least one switch mechanism controls playback of the at least one pre-loaded digital audio file.

In another embodiment, the three-dimensional foam greeting card of the present invention contains a three-dimensional foam body having at least one hollowed out portion creating a cavity therein, a first planar surface attached to a front surface of the three-dimensional foam body, a second planar surface attached to a back surface of the three-dimensional foam body, a sound module comprising a speaker, circuit board, integrated circuit, microprocessor, power source, memory device and at least one pre-loaded audio file, a recording device, a first switch to initiate a user recording session, and a second switch to initiate playback of the at least one pre-loaded audio file or a user recorded message.

In still another embodiment, the foam greeting card contains a three-dimensional foam body with a perimeter wall which extends between two spaced apart parallel pieces of heavy gauge planar sheet material, and a multimedia player device located and concealed within the three-dimensional foam body. The multimedia player device may include a circuit board, integrated circuit, microprocessor, speaker, power source, memory device, an electronic display screen operative to display digitally generated images, a data storage device, at least one switch mechanism, and at least one pre-loaded digital audio or video file. The electronic display screen is visible through an opening in the three-dimensional foam body and one of the pieces of heavy gauge planar sheet material.

DETAILED DESCRIPTION OF PREFERRED AND ALTERNATE EMBODIMENTS

The present disclosure and related inventions provide foam constructs in the form of greeting devices, greeting cards, novelties, gifts and foam constructs with functional features, and which can be used in connection with other devices such as retail displays.

Figure 3:
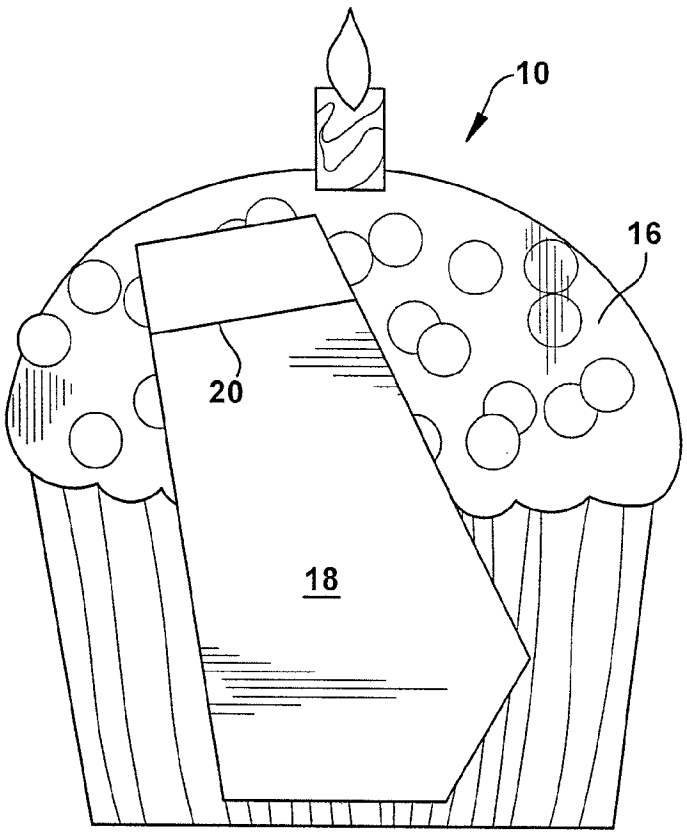
FIG. 3 is a rear view of the three-dimensional foam greeting card of FIG. 1.
Figure 2:
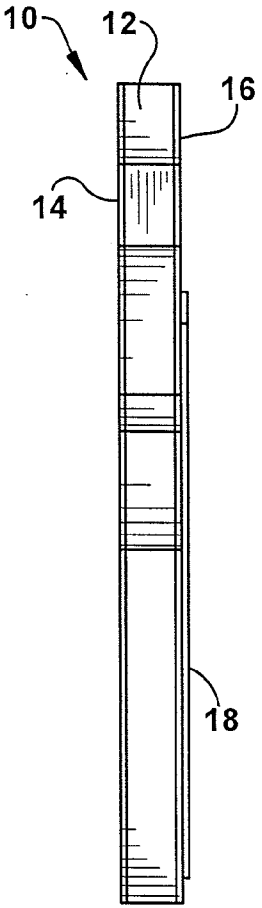
FIG. 2 is a side view of the three-dimensional foam greeting card of FIG. 1.
Figure 9:
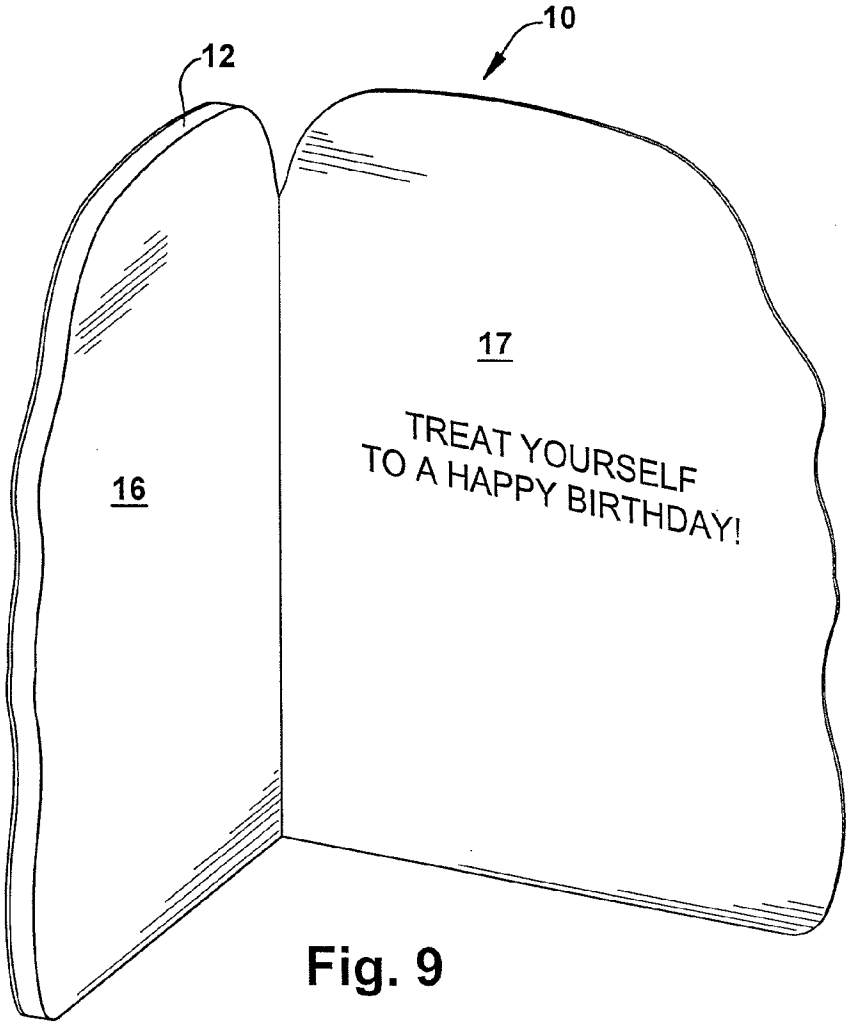
FIG. 9 is a perspective view of the three-dimensional foam greeting card of FIG. 8 in an open position.
Figure 8:
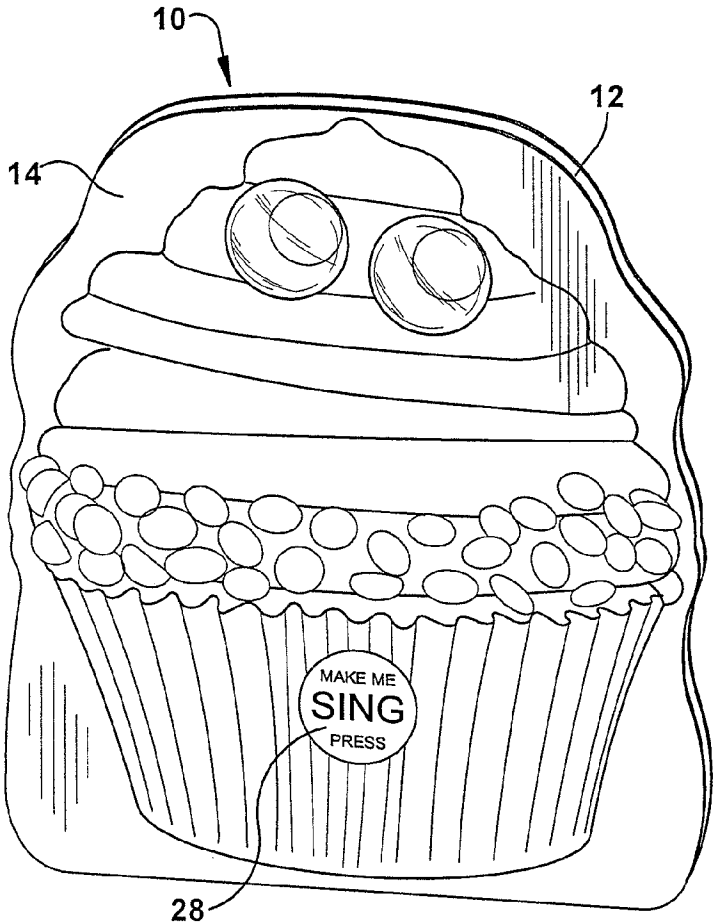
FIG. 8 is a front view of an alternate embodiment of the three-dimensional foam greeting card of the present invention in a closed position.

In one form, a three-dimensional foam greeting card according to the present invention contains a foam body made of a hardened foam or foam-like material which makes the greeting card very lightweight. A representative example is shown in FIGS. 1-4. The foam body 12 of the greeting card 10 can be formed into any shape or profile, examples of which include, but are not limited to: a circle, a cupcake, a candle, an animal, a person, a baby carriage, a Christmas tree, a pumpkin, or any other conceivable shape. Or the greeting card 10 may take on a square or rectangular shape of a traditional greeting card. A portion of the foam body 12 is hollowed out to accommodate a device, examples of which include, but are not limited to: a sound module (shown in FIG. 4), a light module, a motor module, a multimedia player device or any combination thereof. There may be multiple cavities formed in the foam body 12 to receive multiple devices or device components such as batteries, switches, circuit boards, speakers, motors, recording devices, etc. The front and back surfaces of the foam body 12 are generally planar and can be covered with a heavy gauge paper-like material such as paper, cardboard, cardstock, or any other sheet or planar material. The outer paper-like surface 14, 16 can be cut in the shape of the foam body 12 and pre-printed with a design consistent with the shape of the foam body 12. The front surface 14 may bear decoration consistent with a front view of the item and the back surface 16 may contain decoration consistent with the back view, of the item. For example, if the foam body and outer cover contain the shape and decoration of a dog, the front cover of the foam greeting card may contain the right side profile of the dog and the back cover may contain the left side profile of the dog. The outer surfaces 14, 16 are adhesively or otherwise attached to the foam body 12. The greeting card 10 may contain, in addition to the three-dimensional foam body 12 with planar front 14 and back 16 surfaces, a sentiment panel 17, which may be connected to the planar sheet material located on either the front 14 or back 16 surface of the foam body 12. This configuration is shown in FIGS. 8 and 9. The sentiment panel 17 may be, as shown, shaped in the same way as the foam body 12 and corresponding front 14 and back 16 sheet materials. If the sentiment panel 17 is connected along a fold line to the planar sheet material located on the front surface 14 of the foam body 12, it would serve as an outside front cover and an inside left panel of the greeting card 10. In a closed position, the sentiment panel 17 would be folded over the front surface 14 of the foam body 12 revealing only the outer surface of the sentiment panel 17. In an open position, it would be folded away from and revealing the front surface 14 of the greeting card 10 and the inner surface of the sentiment panel 17. Text sentiment and/or printed photographs or graphics may be contained on both the inside and outside surface of the sentiment panel. If the sentiment panel is connected along a fold line to the planar sheet material located on the back surface 16 of the foam body 12, as is shown in FIG. 9, it would serve as an outside back cover of the greeting card 10 and an inside right panel of the greeting card 10. In a closed position, the sentiment panel 17 would be folded over the back surface 16 of the greeting card 10. In an open position, it would be folded away from the back surface 16 of the greeting card 10 revealing the back surface 16 of the greeting card 10 and the inner surface of the sentiment panel 17. The three-dimensional greeting card 10 may additionally contain a display arm 18 attached to the back surface 16 of the greeting card 10, as shown in FIG. 3. The display arm 18 may be made out of cardboard or other rigid material. The upper portion of the display arm 18 is creased along a fold line 20 so that the display arm 18 may bend outward to function as a support for the greeting card 10, allowing the greeting card 10 to be displayed in a standing position.

Figure 4:
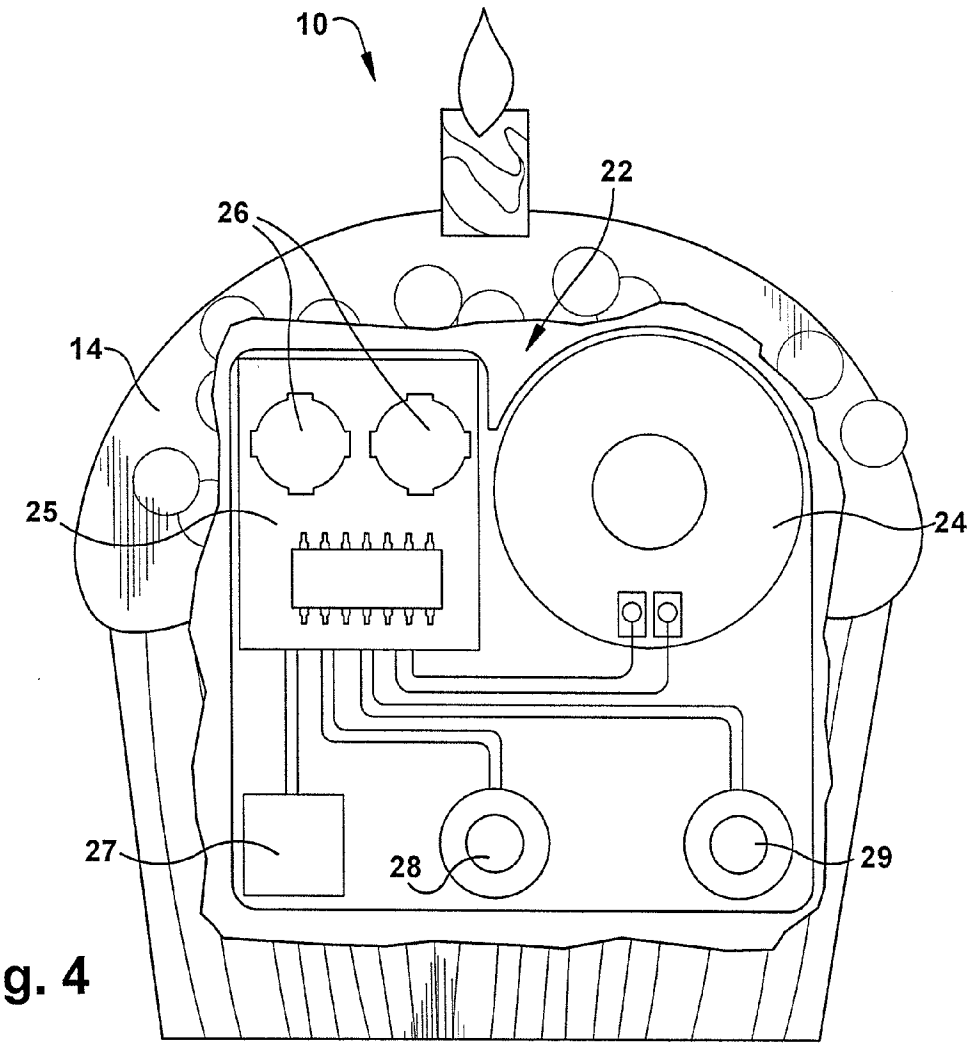
FIG. 4 is a front internal view of the three-dimensional foam greeting card of FIG. 1.

In another embodiment, the foam greeting card, as described above, may contain a sound module 22, as shown in FIG. 4. Components of the sound module may include a circuit board 25, an integrated circuit, a microprocessor, a speaker 24, a memory module, a power source 26, a switch 28, and any other components necessary to trigger and playback a pre-recorded digital audio file. The digital audio file may contain music, singing, a voice message, or any other recordable sound. Components of the sound module 22 may be contained and concealed within a hollowed out portion of the foam body 12. The switch 28 which triggers playback of the audio file may be an electro-mechanical push-button switch 28. This type of switch, may be implemented as a press-button 28, wherein each time a user presses the button, playback of the audio file is initiated. A sticker or printed label may be placed above the press-button switch on the outer surface 14 of the greeting card 10 to indicate that this is the area the user must press to playback the audio file. The sticker or printed label may simply say "play" or "press here". Alternatively the surface of the greeting card 10 above the press-button may be printed with words and/or indicators to designate the location of the push-button 28. The switch may alternatively be a mechanical on/off switch which may be located on the front or back surface of the foam greeting card or it may also be located along the perimeter of the foam body 12. A slide trigger switch may also be used to initiate playback of the pre-recorded digital audio file. This type of switch may be particularly used with a foam greeting card having a sentiment panel, as described above, attached to the front or back surface of the greeting card. A slide switch mechanism may be placed over a fold line between the sentiment panel and the foam body such that when the greeting card is opened by moving the sentiment panel away from the foam body, the slide trigger activates the pre-recorded audio. Other switch mechanisms may be used such as light sensitive switches, motion sensitive switches, touch sensitive switches, pressure sensitive switches, thermal switches, moisture or capacitive switches or any other switch which would be known to one skilled in the art.

Figure 1:
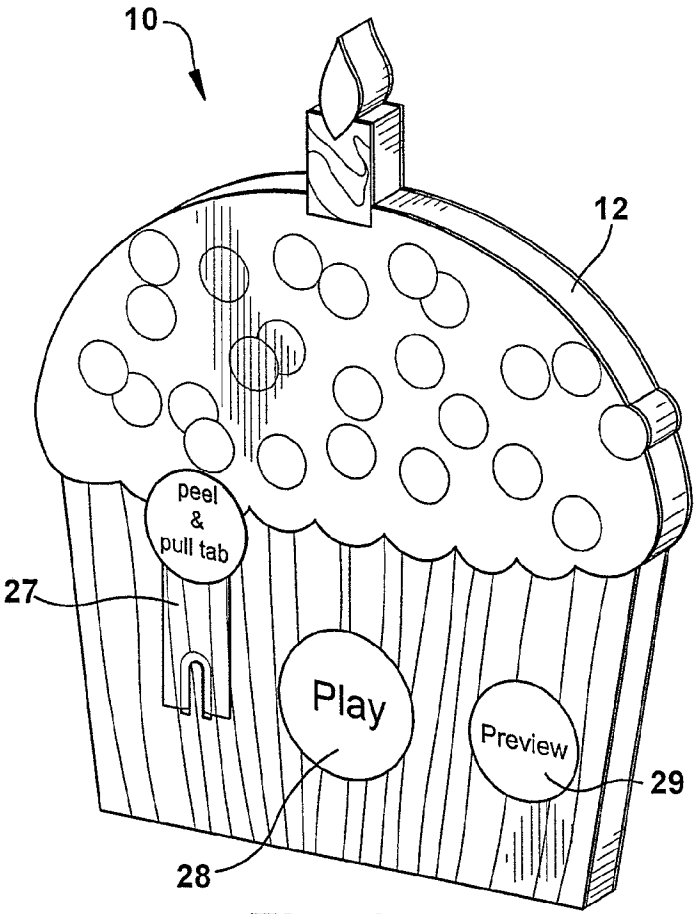
FIG. 1 is a perspective view of a first embodiment of the three-dimensional foam greeting card of the present invention.

In another embodiment, the three-dimensional foam greeting card, as described above, contains both a sound and recording module that provide the user with the ability to record a personalized message to the card recipient. As shown in FIGS. 1 and 4, this embodiment may include at least two electro-mechanical switches 28, 29 to initiate a recording session and a playback session and a microphone. A first switch 28 or "play" button, which may be implemented as a push-button switch as described above, may in a first mode initiate playback of a pre-recorded message instructing the user how to record a personal message and in a second mode initiate playback of the user's personal message. A second switch 29, or "preview" button, which may also be implemented as a push-button, may initiate a recording session wherein the user may record a personal message to the greeting card recipient. A third switch 27 or pull tab is located on the outer surface of the greeting card. This third switch 27 controls whether the greeting card 10 is in a first mode, wherein a user can test the card functionality by recording and previewing the recorded message without the ability to play the message a second time or to hear the message upon pressing the "play" button, or a second mode, wherein the user has purchased the greeting card, and removed the pull tab 27 thereby permitting the user to record a message which is then saved within the sound module and is thereby available for playback upon pressing the "play" button 28. The third switch or pull tab 27 may be located on the outer surface of the greeting card 10 so that is visible to the purchaser. While the pull tab 27 is still intact, pressing the "play" button will initiate playback of a pre-recorded voice message instructing the user how to record a personal message. Once the pull tab 27 has been removed, pressing the "play" button 28 will initiate playback of the user-recorded message. Pressing the "preview" button 29 initiates a recording session, regardless of whether the pull tab 27 has been removed or not. The recording session will continue as long as the user continues pressing or holding down the "preview" button 29 or until the amount of storage allotted for the user-recorded message has been exhausted. Once the user has finished recording the personal message, the personal message will automatically be played back. In the first mode, when the pull tab 27 is still intact, the user-recorded message is played back once and discarded, disabling further playback of the user-recorded message. In the second mode, once the pull tab 27 has been removed, the user-recorded message is immediately played back and saved so that it can be re-played by pressing the "play" button 28. The user may record over a previous message simply by pressing the "preview" button 29 and recording a new message which will overwrite the previously saved user-recorded message. The "preview" button 29 may be indicated on the outer surface of the greeting card by a removable sticker or label. Once the user purchases the greeting card and has recorded a satisfactory message, he/she can remove the "preview" sticker or label before sending the greeting card to the recipient.

Figure 6:
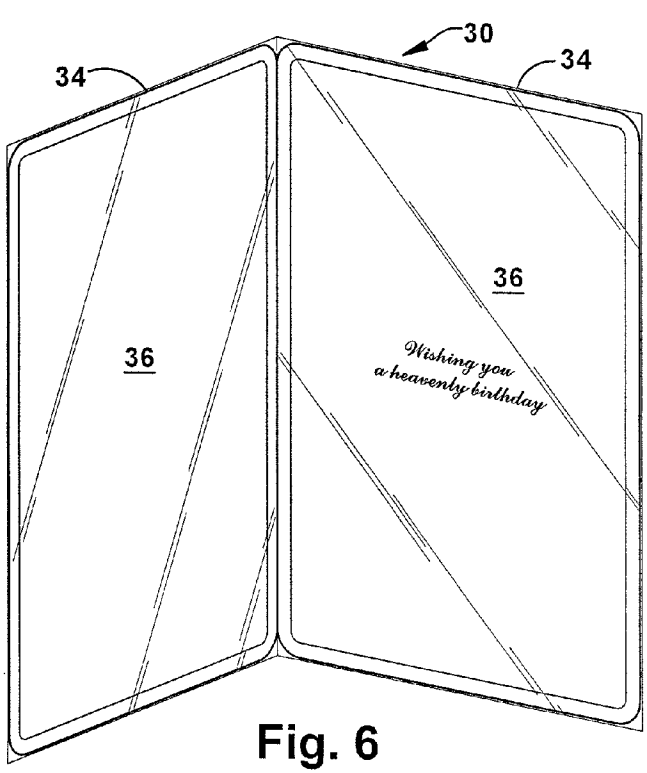
FIG. 6 is a perspective view of the three-dimensional foam greeting card of FIG. 5 in an open position.
Figure 7:
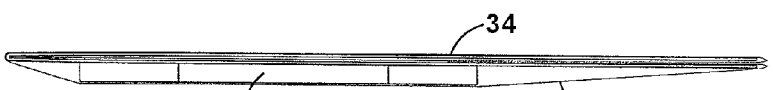
FIG. 7 is a top view of the three-dimensional foam greeting card of FIG. 5 in the direction of arrows 7-7.
Figure 5:
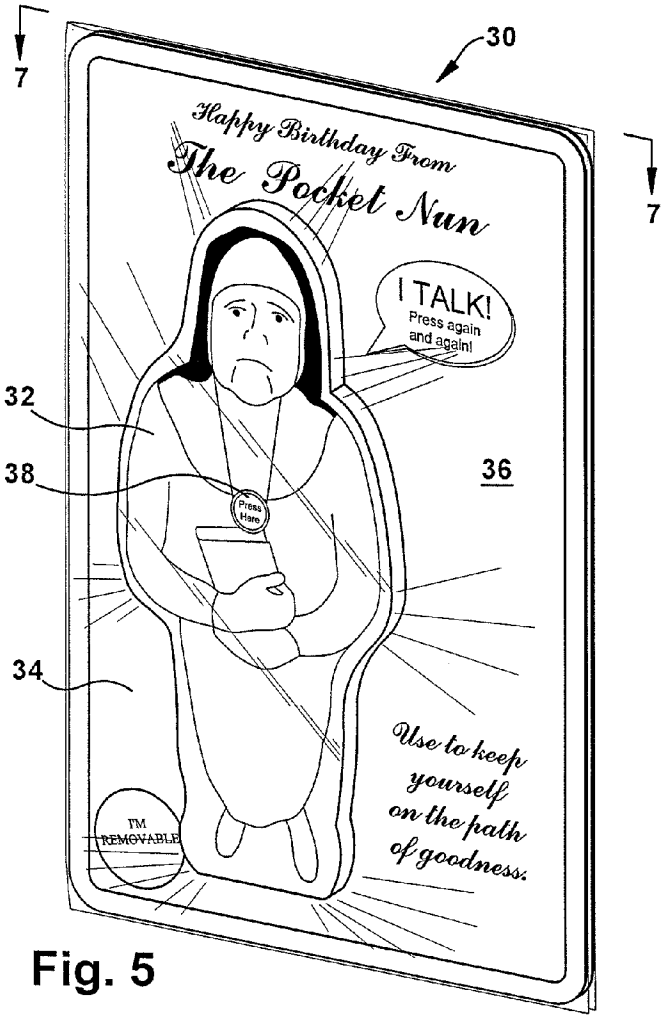
FIG. 5 is a perspective view of an alternate embodiment of the three-dimensional foam greeting card of the present invention in a closed position.

In another form, the three-dimensional foam greeting card of the present invention may be paired with a traditional paper greeting card, such as is shown in FIGS. 5-7. In this embodiment, the removable foam greeting card 32 may serve as a keepsake or token once the paper greeting 34 has been discarded. As shown in FIGS. 5-7, a sealed clear or transparent sleeve 36 made of plastic or other such material is used to pair the separate foam structure 32 and paper greeting card 34 in the same package. The foam structure 32 may be inserted into the sleeve 36 in front of the paper greeting card 34 so it is visible when looking at the greeting card 30 on a greeting card display. Alternatively, the foam structure 32 may be placed on the inside of the paper greeting card 34 to be discovered by the card recipient upon opening the greeting card 30. The foam structure 32 may contain sound, recording, light, motor, multimedia module, or combinations thereof as described in further detail below. As shown in the representative embodiment, the removable foam structure 32 contains a press button 38 which controls activation of an internal sound module, similar to the sound module shown in FIG. 4. Depression of the press button 38 may initiate playback of a pre-loaded audio file containing a voice message, music, sound, or any other digital recording.

Figure 11:
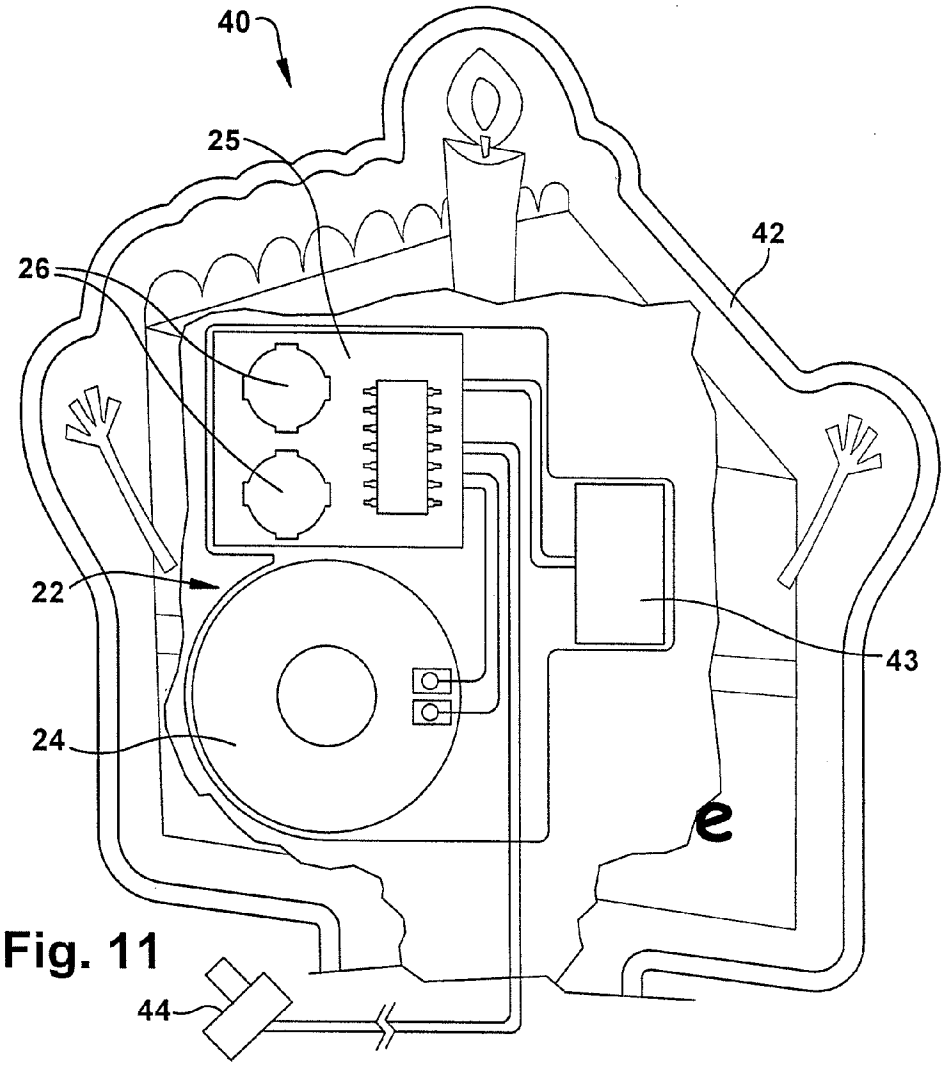
FIG. 11 is an internal view of a portion of the three-dimensional foam greeting card of FIG. 10.
Figure 10:
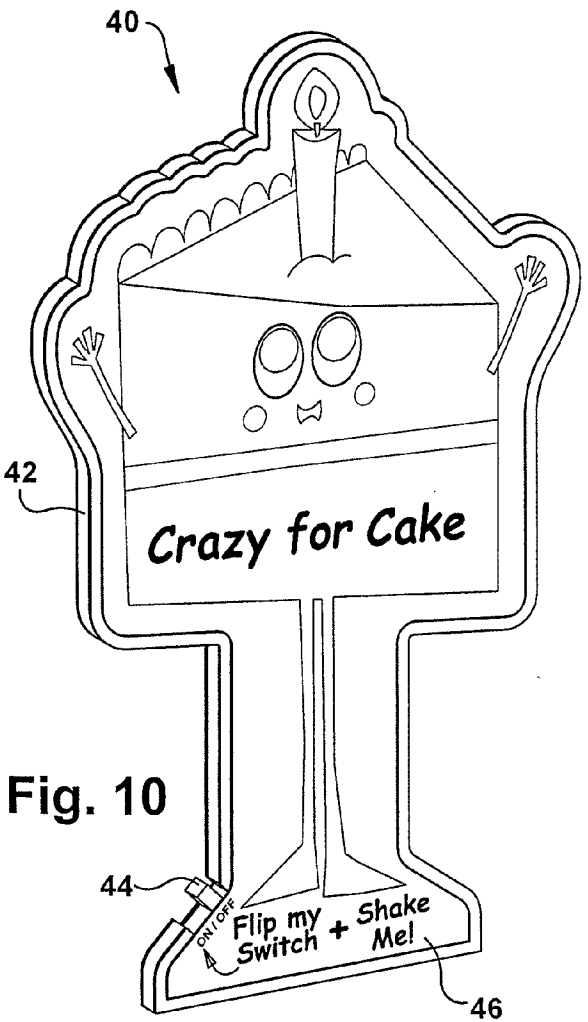
FIG. 10 is a perspective view of an alternate embodiment of the three-dimensional foam greeting card of the present invention.

The three-dimensional foam greeting card with sound, as described above, can additionally contain a motion sensor which operates to trigger one or more pre-loaded audio files. A representative example is shown in FIGS. 10-11. In this embodiment, in additional to the sound module 22 as described above, contains a motion sensor 43 within the cavity in the foam body 42. The motion sensor 43 can be used, in one embodiment, to trigger playback of a first pre-loaded audio file. In another embodiment, a first pre-loaded audio file may be played upon activating a first switch such as a push button switch or toggling a mechanical on/off button 44, as shown in FIGS. 10-11. After the first pre-loaded audio file is played back, movement of the foam body 42 activates the motion sensor 43, which triggers a second pre-loaded audio file. For example, the greeting card 40 may contain instructions to "shake me" 46 so that when the user begins to shake the foam body 42, the motion sensor 43 triggers playback of a pre-loaded audio file.

In another embodiment, the three-dimensional foam greeting card of the present invention may contain a light module with integrated LED lights. The light module would contain A light strand may be stored within a hollowed out portion of the greeting card body between the front and back surfaces of the card. The lights may be programmed to strobe in sequence or blink randomly. Different light colorations may be used as well. Other types of lighting, such as ribbon LED lights may also be used. An electro-mechanical push-activated switch may be used to allow the user to control whether the lights are turned on or off. Also, the lights may be used in combination with pre-recorded sound or a user-recorded message. A single switch may initiate playback of a pre-recorded or user-recorded message as well as turning the lights on or the audio playback and lights may be controlled by different switches.

In yet another embodiment, the three-dimensional foam greeting card of the present invention may contain a motor module located in the hollowed cavity in the foam located between the front and back panels of the greeting card. The motor module causes movement of at least one mobile object associated with the greeting card. The movement nay be up and down motion, side to side lateral motion, or any other reciprocating motion. The motor module may contain a rotating gear mechanism that when activated turns a circular gear which is attached at one end to the mobile object. The mobile object can be any three dimensional object which extends outward from the front surface of the greeting card body. Activation of the motor module, which can be by a push button switch, slide switch, or any other switching mechanism, causes movement of the mobile object. Other novelties may be attached to the outside surface of the foam body such as moving eyes or other decorative embellishments.

Figure 13:
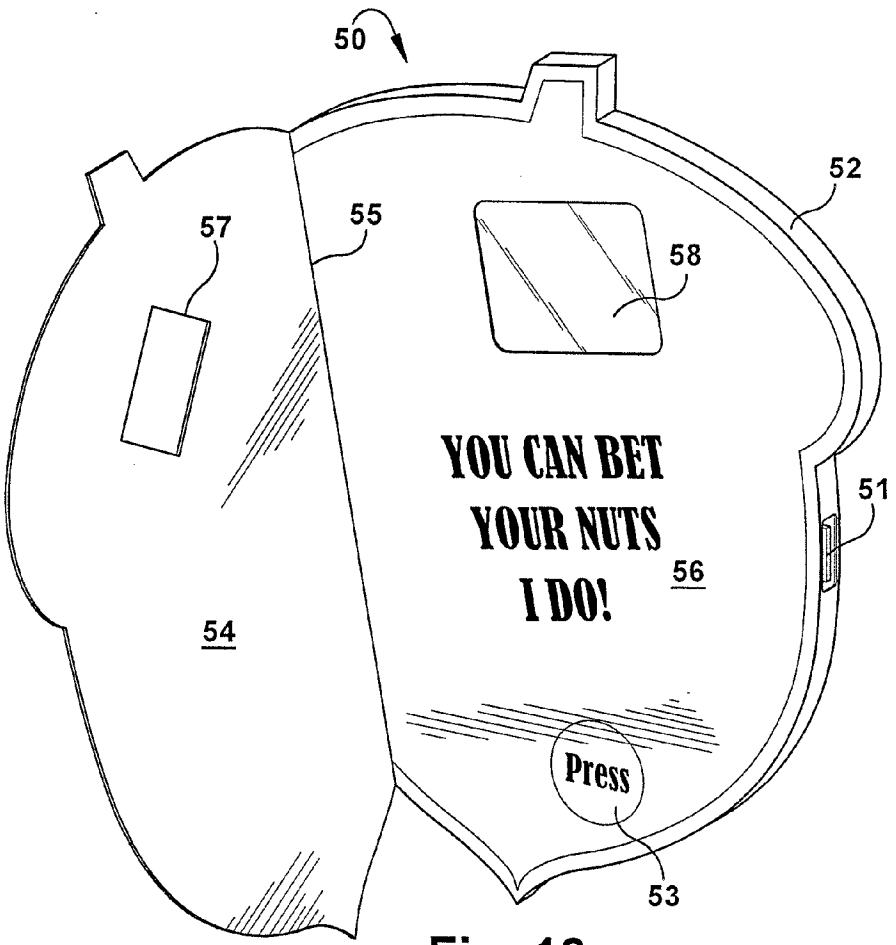
FIG. 13 is a perspective inside view of the three-dimensional foam greeting card of FIG. 12 in an open position.
Figure 12:
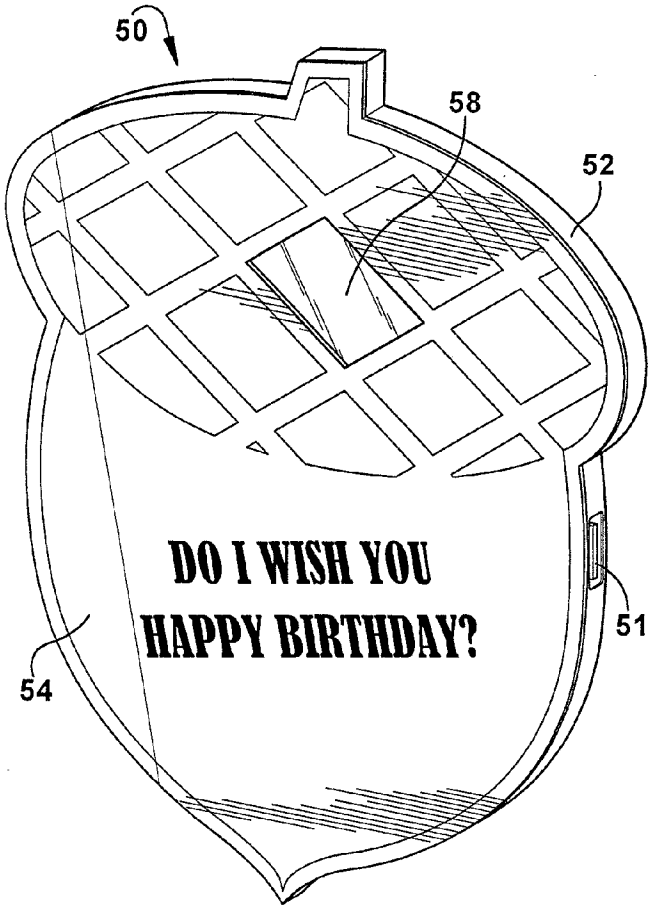
FIG. 12 is a perspective view of an alternate embodiment of the three-dimensional foam greeting card of the present invention in a closed position.
Figure 15:
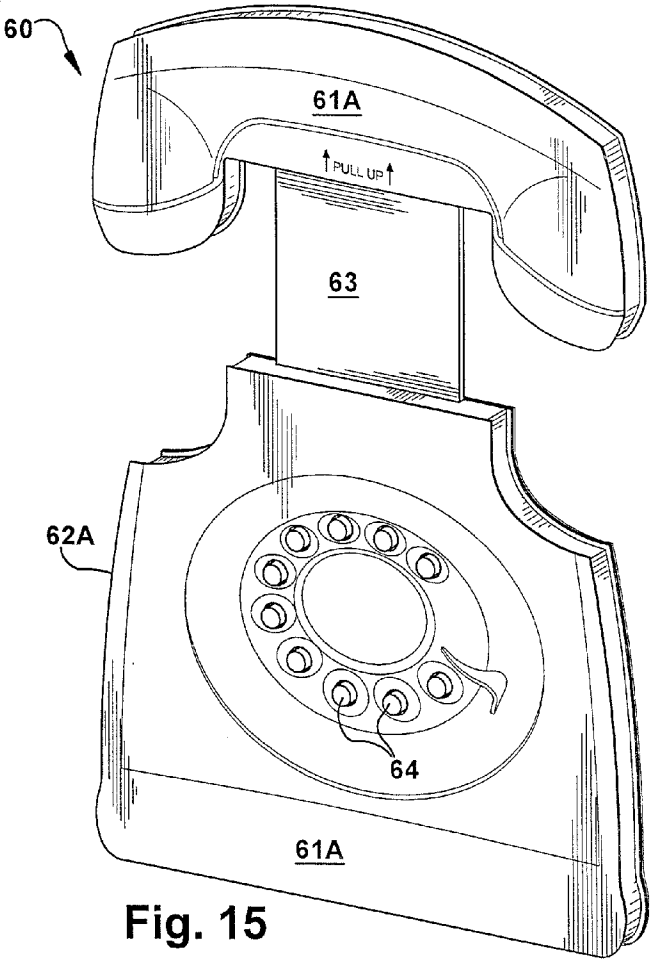
FIG. 15 is a perspective view of the three-dimensional foam greeting card of FIG. 14 in an open position.
Figure 14:
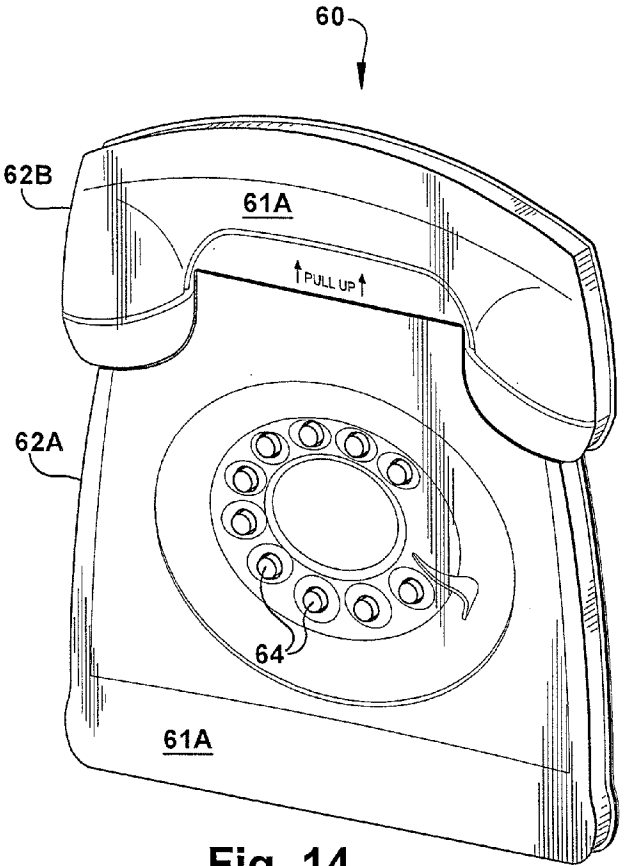
FIG. 14 is a perspective view of an alternate embodiment of the three-dimensional foam greeting card of the present invention.
Figure 17:
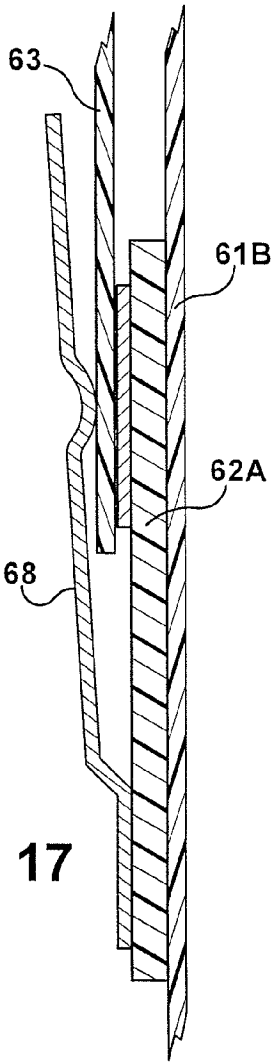
FIG. 17 is a side internal view of the three-dimensional foam greeting card of FIG. 14.
Figure 16:
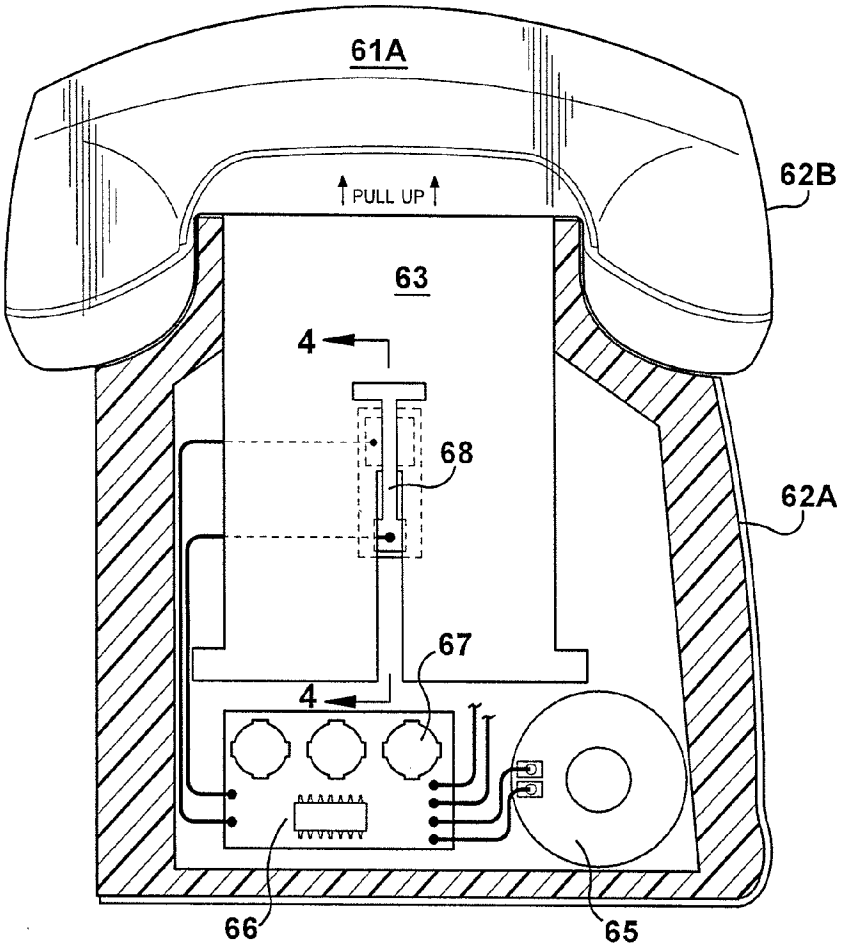
FIG. 16 is a front internal view of the three-dimensional foam greeting card of FIG. 14.
Figure 19:
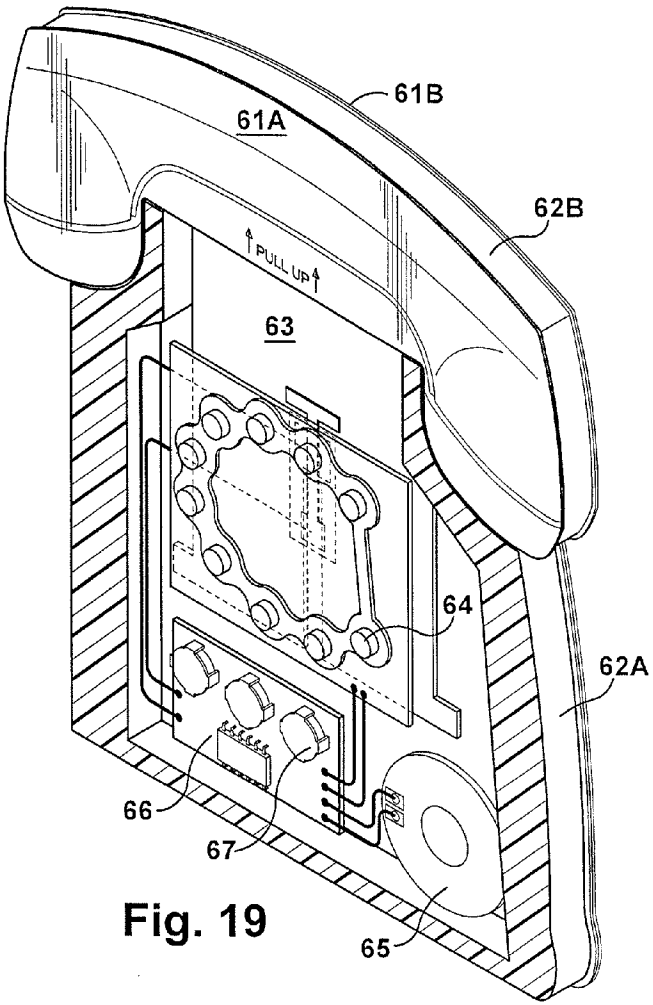
FIG. 19 is a perspective internal view of the three-dimensional foam greeting card of FIG. 14.
Figure 18:
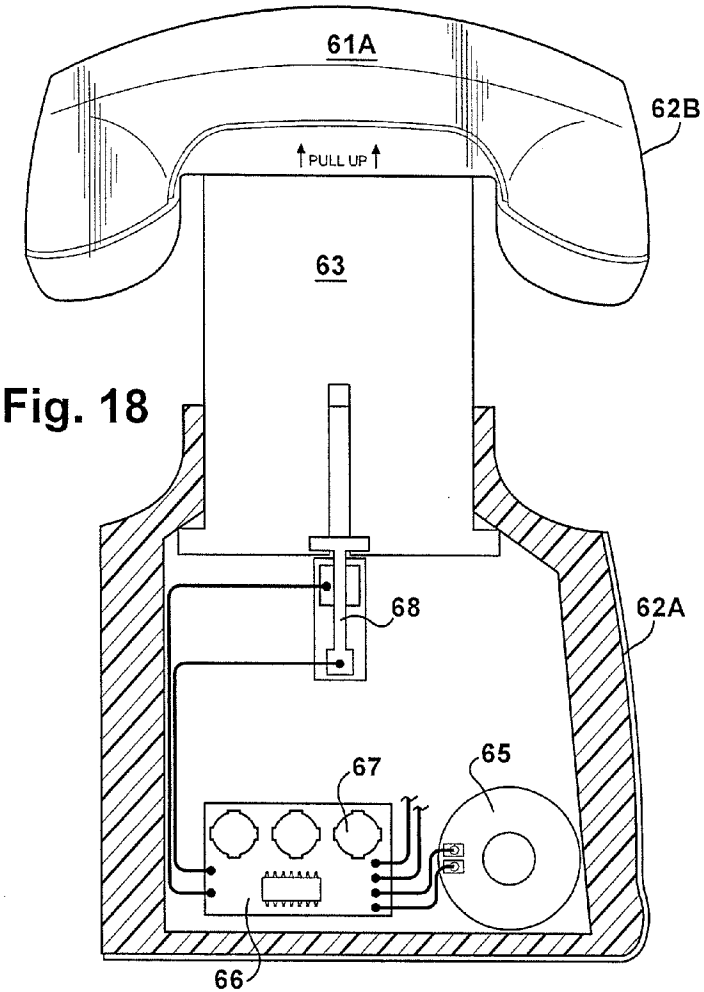
FIG. 18 is a front internal view of the three-dimensional foam greeting card of FIG. 14 in an open position.
Figure 20:
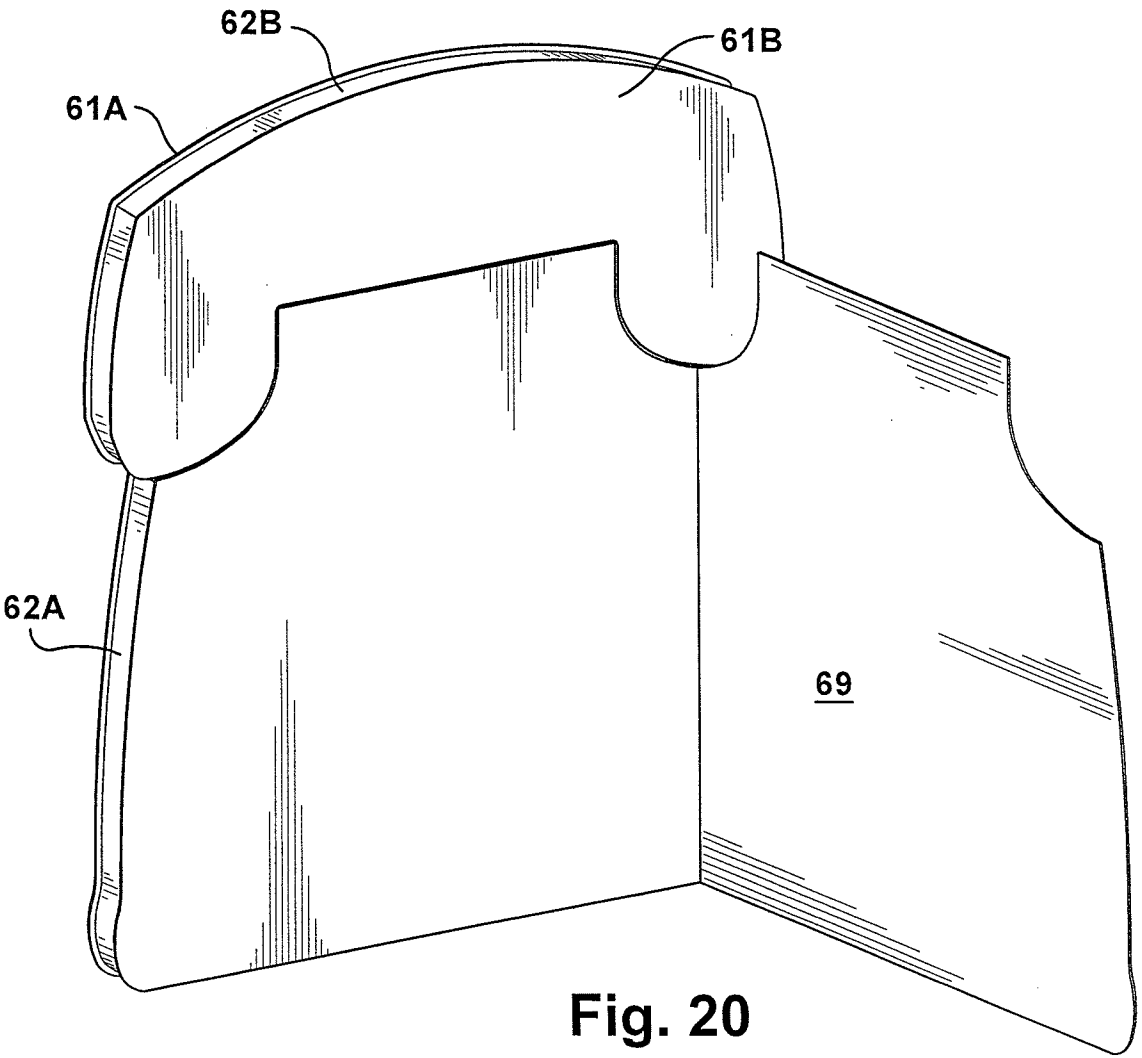
FIG. 20 is a perspective view of the rear of the three-dimensional foam greeting card of FIG. 14.

In still another embodiment, the three-dimensional foam greeting card of the present invention may be operative to play pre-loaded video and/or audio recordings. In this embodiment, a representative example of which is shown in FIGS. 12 and 13, a multimedia player device is contained within the hollowed cavity in the foam body 52 located between the front and back panels of the greeting card 50. The multimedia player device may be capable of displaying pre-loaded images or video and emitting sound. Components of such multimedia player device may include, but are not limited to, a flat panel display screen 58, such as an LCD screen, a power source which preferably consists of one or more disposable batteries, an audio speaker, integrated circuit, a circuit board with microprocessor, a data storage device and related circuitry. The device may contain at least one pre-recorded slideshow with accompanying pre-recorded digital audio files. A representative device may store up to approximately 20 pre-loaded photos or images and between approximately 26 seconds to 2.26 minutes of audio or greater, depending on the amount of digital storage provided. The device, when powered by four disposable lithium batteries, is capable of playing the pre-loaded audio/visual content approximately 300 times. Representative width and/or height dimensions of a display screen 58 are between approximately 1.5 and 2.4 inches. The screen 58 may be visible through an opening in the planar sheet material located on the front surface 56 of the foam body 52. The foam greeting card body 52 may additionally contain a sentiment panel 54, as described above, which is attached along a fold line 55 to the planar sheet material attached to the front surface 56 of the foam body 52. The sentiment panel 54 would serve as the front cover of the greeting card 50 and in a closed position, lay atop the sheet material attached to the front surface 56 of the foam body 52. The sentiment panel 54 may also contain an opening thereon 57, consistent with the opening for the display screen 58 contained on the planar sheet material located on the front surface 56 of the foam body 52, through which the display screen 58, contained within the foam body 52, is visible. The multimedia display device may be activated by a push button switch 53 located on the front or back surface of the foam body 52. The greeting card 50 may contain the words "play" printed above the push button switch 53 which indicates where the multimedia player device is activated. Alternatively, the greeting card 50 may contain a slide switch which is used in combination with a sentiment panel 57, as described above. The slide switch may be located across a fold line 55 between the sentiment panel 54 and the foam greeting card body 52, such that when the greeting card 50 is opened or the sentiment panel 54 is folded away from the greeting card body 52, the slide switch works to activate the multimedia player. The greeting card 50 may additionally contain a mechanical on/off switch or button which controls whether or not the multimedia player device may be activated. The on/off switch may be located along the side perimeter of the foam body 52 between the planar sheet material located on the front and back surfaces of the foam body or it may be located on the front or back surface of the greeting card body.

A further embodiment of the three dimensional foam greeting card with multimedia player device, as described directly above, may contain audio recording capabilities which would provide a user with the ability to record a personalized message to be played before, during or after the pre-recorded slideshow is displayed on the display screen. Additional components such as a sound and recording module, as described above with reference to a previous embodiment, would accompany the multimedia player device within the cavity located within the foam body between the front and back panels of the greeting card. The multimedia player device may contain one or more pre-recorded audio files that may be played before during or after the personalized user recorded message.

Further still, the three dimensional foam greeting card with multimedia player device may additionally include a USB port 51, SD slot or any other appropriate external memory input source so that a user may upload digital video, digital photos and/or digital audio files to be presented on activation of the multimedia device. The multimedia device may be capable of playing several file formats including, but not limited to, flash, html, html5, mp3, mp4, .mov, .rp4, /wma, etc. The multimedia player device may also contain one or more pre-loaded digital video, photo and/or audio files which may be played in combination with the user uploaded digital video, photo and/or audio. The video, slideshow and/or audio may be triggered by any of the switch mechanisms described herein and playback may further be controlled by a mechanical on/off switch. The switch mechanisms may be located on the front or back of the greeting card or along the side perimeter of the foam structure.

Another embodiment of the three-dimensional foam greeting card of the present invention is shown in FIGS. 14-20. This embodiment includes a three-dimensional foam greeting card body, which as described above with respect to the embodiment shown in FIGS. 1-4, can be made of a hardened foam or foam-like material. The foam body can be formed into different shapes and profiles. For example, in this embodiment, shown in FIGS. 14-20, the foam is formed in the shape of a rotary telephone. A portion of the foam body may be hollowed out to accommodate electronics or components necessary to perform various special effects such as sound, light, movement, video, recording, etc. The components may be contained within a single cavity within the foam body or several smaller cavities contained therein. The front and back surfaces of the foam body are generally planar and may be covered with a heavy gauge paper-like material such as paper, paperboard, cardboard, cardstock, or other such sheet material. The outer paper-like surfaces may be attached directly to the front and back surfaces of the foam body, with the foam perimeter uncovered. The front 61A and back 61B cover material may be printed with various graphics, drawings, photos, text, etc. The printing may be related to the shape of the foam body, such as for example, in the embodiment shown in FIGS. 14-20, the foam is formed to resemble a rotary telephone and the front 61A and back 61B cover material is printed to look like the front and back surface of a rotary telephone, respectively. The greeting card may additionally include a sentiment panel 69 (shown in FIG. 20) which may be connected to the front 61A or back 61B cover material. Preferably, the sentiment panel 69 will be connected along a fold line to the back 61B cover material, thereby creating a traditional paper greeting card attached to the back of the foam body. In the present embodiment shown in FIGS. 14-20, the foam body includes two separate foam pieces 62A, 62B which are slidably connected by an inner panel 63. The first foam piece 62A is the larger of the two pieces and serves as the base or telephone. The base 62A contains the hollowed portion containing the various electronic and other components. These components may include, but are not limited to: a circuit board 66; an integrated circuit chip; a speaker 65; a power source such as batteries 67; a memory chip containing one or more pre-recorded digital audio files thereon; and one or more switches 68. The base 62A also contains a series of push-buttons 64 that are accessible through the front of the foam body 62A via openings in the front cover material 61A. In the example shown in FIG. 14, there are push-buttons 64 which represent the numbers on a telephone. The graphic or printing contained on the front cover material 61A resembles a telephone with numbers printed proximate to each of the push-buttons 64. The second, smaller foam piece 62B serves as the handle or receiver and sits atop or is flush with the top perimeter surface of the first foam piece or the base 62A. Lifting the handle 62B in an upward direction away from the base 62A reveals a hidden inner panel 63 and initiates playback of a first pre-recorded digital audio file. The hidden inner panel 63 connects the first 62A and second 62B foam pieces or the telephone and the receiver. In a preferred embodiment, the hidden inner panel 63 prevents the second foam piece or receiver 62B from becoming completely detached from the first foam piece or the telephone 62A. The hidden inner panel 63 resides in the hollow cavity contained within the first foam piece 62A. A contact switch 68 is also contained within the cavity, wherein when the hidden inner panel 63 is located inside the cavity, a bottom portion of the hidden inner panel 63 is inserted into the contact switch 68, preventing the completion of the electric circuit. When the hidden inner panel 63 is partially removed from the cavity, it is also removed from the contact switch 68, allowing the completed electric circuit, thereby initiating playback of a first audio message. The first pre-recorded audio file may contain spoken instructions for the card recipient which indicate that the recipient should "dial" or press the push-buttons 64 corresponding to the numbers which appear printed on the hidden inner panel 63 to receive a message from a "celebrity" or public figure. Pressing the push-buttons 64 which correspond to the numbers indicated on the inner panel 63 initiates a second pre-recorded digital audio file, which contains a message or song, spoken or sung by a celebrity or public figure. For example, the foam body 62A, 62B may be formed to the shape of a rotary telephone, as shown in FIGS. 14-20. The first foam piece 62A or the base is the telephone and the second foam piece 62B is the receiver. Lifting the receiver 62B upward and away from the telephone 62A reveals an inner panel 63 with the phrase "Push 659 for your celebrity greeting" printed thereon. A first pre-recorded audio message is initiated which contains an introductory message with instructions for the user to dial the indicated number to receive a message from Elvis Presley. After the user dials "659" by pressing the push-buttons 64 corresponding to the appropriate numerals, a second pre-recorded audio file is initiated which contains an Elvis voice impersonator singing Happy Birthday. Putting the receiver 62B back on the telephone 62A or pushing the receiver 62B downward so that the inner panel 63 recedes into the telephone 62A discontinues any currently playing audio. Pictures of Elvis Presley and related graphics or text may be printed on the front 61A or back 61B cover material or on the sentiment 69 or inner 63 panels. Alternatively, several different number codes or sequences may be listed on the inner panel 63 (or elsewhere on the greeting card) which each correspond to a different digital audio recording. When a user enters one code, he/she retrieves a first message, entering a second code plays back a second message, entering a third code plays back a third message, and so on. Also, the greeting card may contain no press buttons but may simply activate sound or other special effects by lifting the handle 62B in an upward direction away from the base 62A. Additional effects, may also be triggered by lifting the handle or receiver 62B, such as illuminating one or more lights on the greeting card or motor movement of a portion of the greeting card.

The three-dimensional foam greeting cards of the present invention may also contain a battery-saving device which includes a small substantially rectangular plastic insert which is inserted into a small slot in the foam body. The slot is located directly outside the location of a battery circuit switch which is contained on the circuit board inside the foam body. When the device is inserted into the slot the circuit is opened, preventing batteries from draining while the product is not in use. When the device is removed, the circuit closes, and the batteries are activated, allowing the user to record a message, play an audio clip, light up the greeting card or cause components of the greeting card to be put in motion.

It should be noted that the three-dimensional foam greeting card described herein may contain one or a combination of two or more functions, as described, such as sound, light, audio, recording, motion, or multimedia functions. Additionally, a variety of switches are mentioned herein and can be used alone or in combination and may be located in a variety of locations on the three-dimensional foam greeting card.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Other features and aspects of this invention will be appreciated by those skilled in the art upon reading and comprehending this disclosure. Such features, aspects, and expected variations and modifications of the reported results and examples are clearly within the scope of the invention where the invention is limited solely by the scope of the following claims.

What is claimed is:

1. A foam greeting card comprising:

a first foam piece, having one or more cavities contained therein;

a second foam piece;

the first and second foam pieces slidably connected by an inner panel, the inner panel movable between a first position wherein the inner panel is contained within a cavity in the first foam piece and a second position wherein the inner panel is partially removed from the first foam piece;

a plurality of push buttons contained within the one or more cavities in the first foam piece and accessed through an opening in a front surface of the first foam piece;

a first switch which controls playback of a first digital audio recording, which plays upon moving the inner panel from the first position to the second position;

a second switch which controls playback of a second digital audio recording, which plays upon a user pressing a sequence of the plurality of push buttons.

2. The foam greeting card of claim 1, wherein the first switch is a contact switch.

3. The foam greeting card of claim 2, wherein the contact switch works in combination with the inner panel.

4. The foam greeting card of claim 1, wherein the first and second foam pieces are shaped in the form of a rotary telephone.

5. The foam greeting card of claim 1, wherein the plurality of push buttons corresponds to a number in the range of 0 through 9.

6. The foam greeting card of claim 5, wherein the inner panel contains a sequence of numbers between 1 and 10 which when entered via the plurality of press buttons triggers playback of the second digital audio recording.

7. The foam greeting card of claim 1, wherein a planar surface material is attached to a front and back surface of the first and second foam pieces.

8. A foam greeting card comprising:

a first foam component slidably connected to a second foam component via a hidden inner panel;

the first foam component is movable between a first position wherein the first foam component is in contact with the second foam component and a second position wherein the first foam component is not in contact with the second foam component;

a sound module contained within the second foam component;

a switch contained within the second foam component;

a plurality of push buttons which each correspond to a distinct number in the range of 0 through 9;

wherein when the first foam component is moved from the first position to the second position, a first digital audio file is initiated and the hidden inner panel is revealed, the hidden inner panel containing a series of numbers corresponding to one or more of the plurality of push buttons, and wherein when each of the push buttons corresponding to the series of numbers contained on the hidden inner panel is pressed, a second digital audio file is initiated.

9. The foam greeting card of claim 8, wherein the first and second foam components combine to form the shape of a rotary telephone.

10. The foam greeting card of claim 8, wherein the plurality of push buttons is accessed through an opening in a front surface of the second foam component.

11. The foam greeting card of claim 8, wherein the second digital audio file contains spoken words or song sung by a celebrity or celebrity impersonator.

12. The foam greeting card of claim 8, wherein a one panel of a two panel greeting card is attached to a back surface of the second foam component.

13. The foam greeting card of claim 8, wherein a front and back surface of the first and second foam components are covered with a planar paper-like material.

14. The foam greeting card of claim 8, wherein the hidden inner panel contains instructions for the user to enter the series of numbers contained on the hidden inner panel via the plurality of push buttons.

15. The foam greeting card of claim 8, wherein the first digital audio file contains spoken instructions for the user to enter the series of numbers contained on the hidden inner panel via the corresponding push buttons.

16. A foam greeting card comprising:

a foam body shaped as a rotary telephone, having a first portion shaped like a telephone receiver and a second portion shaped like a telephone base;

a hidden inner panel contained within a cavity in the second portion of the foam body, the hidden panel connecting the first and second portions of the foam body;

a sound module contained within the cavity in the second portion of the foam body;

ten press buttons arranged in a semi-circular array and protruding from a front surface of the second portion of the foam body, each of the ten press buttons corresponding to a number from 0 through 9;

lifting the first portion of the foam body away from the second portion of the foam body reveals the hidden inner panel, the hidden inner panel having at least one number printed thereon;

pressing the press button which corresponds to the at least one number printed on the hidden inner panel initiates playback of at least one audio file.

17. The foam greeting card of claim 16, wherein playback of a second audio file is initiated upon lifting the first portion of the foam body away from the second portion of the foam body.

18. The foam greeting card of claim 16, wherein the numbers which correspond to each of the ten press buttons is printed on the front surface of the second portion of the foam body proximate to each corresponding press button.

19. The foam greeting card of claim 16, wherein the at least one audio file contains audio of a celebrity or celebrity impersonator.

20. The foam greeting card of claim 16, wherein one panel of a two panel greeting card is attached to a back surface of the second portion of the foam body.

* * * * *